US011306647B1

(12) United States Patent
Huelsmann et al.

(10) Patent No.: US 11,306,647 B1
(45) Date of Patent: Apr. 19, 2022

(54) COMBUSTION GAS LEAK DETECTION STRATEGY

(71) Applicant: Caterpillar Inc., Peoria, IL (US)

(72) Inventors: Joseph M. Huelsmann, Washington, IL (US); Jeffrey J. Speichinger, Peoria, IL (US); Teddy E. Kingham, Metamora, IL (US); Mark A. Kelly, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/242,840

(22) Filed: Apr. 28, 2021

(51) Int. Cl.
*F01P 11/18* (2006.01)
*F01P 11/16* (2006.01)
*F01P 5/10* (2006.01)

(52) U.S. Cl.
CPC ..... *F01P 11/18* (2013.01); *F01P 5/10* (2013.01); *F01P 11/16* (2013.01); *F01P 2025/04* (2013.01); *F01P 2025/32* (2013.01); *F01P 2031/18* (2013.01); *F01P 2031/20* (2013.01)

(58) Field of Classification Search
CPC ..... F01P 11/18; F01P 2025/04; F01P 11/16; F01P 5/10; F01P 2031/36; F01P 7/00; F02D 28/00; F02D 41/005
See application file for complete search history.

(56) References Cited

U.S. PATENT DOCUMENTS 4,667,507 A 5/1987 Eriksson
5,381,762 A * 1/1995 Evans ..... F01M 11/02 123/41.29
5,868,105 A * 2/1999 Evans ..... H01M 8/04029 123/41.5
7,918,129 B2 4/2011 Coppola et al.
9,790,842 B2 10/2017 Dudar et al.
10,151,233 B2 12/2018 Martin et al.
10,648,397 B2 5/2020 Rollinger et al.
2014/0303838 A1* 10/2014 Nam ..... B60K 11/02 701/36
2019/0040815 A1* 2/2019 Nishida ..... F02F 1/40
2019/0284986 A1* 9/2019 Gonze ..... F01P 7/164
2020/0063653 A1* 2/2020 Sugimoto ..... F02M 21/0212
2020/0362800 A1* 11/2020 Keblusek ..... F02D 41/005

FOREIGN PATENT DOCUMENTS

WO 2007057312 A1 5/2007

* cited by examiner

*Primary Examiner* — Long T Tran
(74) *Attorney, Agent, or Firm* — von Briesen & Roper, s.c.

(57) ABSTRACT

A work machine with a remote diagnostic system includes a combustion engine, a pump, a coolant temperature sensor to monitor and transmit a coolant fluid temperature, a pressure sensor coupled to an inlet of the pump, and a controller. The pressure sensor is configured to monitor and transmit a coolant fluid pressure. The controller is operatively associated with the engine, the coolant fluid temperature sensor, the pressure sensor and an equipment care advisor module. The equipment care advisor module is configured to monitor the coolant fluid temperature during a start-up of the work machine, monitor the coolant fluid pressure during the start-up of the work machine, calculate an expected coolant fluid pressure based on the monitored coolant fluid temperature and the monitored coolant fluid pressure, and generate a failure code indicating a combustion gas leak when the monitored coolant fluid pressure exceeds the expected coolant fluid pressure.

20 Claims, 4 Drawing Sheets

COMBUSTION GAS LEAK DETECTION STRATEGY

TECHNICAL FIELD

The present disclosure generally relates to engine system diagnostics and, more specifically, to systems and methods for detecting combustion gas leaks in a work machine.

BACKGROUND

Combustion engines rely on the ignition and combustion of fuel and air within a cylinder to generate pressure and kinetic energy to, ultimately, cause rotation of a crankshaft. The gases generated during combustion are typically sealed within the combustion chamber of the engine via a head gasket. Various types of seals and cylinder liners also assist in retaining combustion gases within engine cylinders. Failure of a head gasket, a cracked cylinder liner, or even an eroded seal can easily permit combustion gases to leak into the engine cooling system, causing damage to the engine.

Detecting a combustion gas leak is time consuming and often requires costly testing kits. This is because combustion gas leaks typically manifest as failures of the engine cooling system. For example, as combustion gas leaks into the engine cooling system of a work machine, the gas can aerate the coolant fluid, causing a typical diagnostic system for the work machine to generate a failure code indicating a reduction in coolant flow. The aeration can also cause excessive coolant overflow, causing the diagnostic system to generate a failure code simply indicating the level of coolant is low. In both of these examples, the damage to the engine or engine cooling system may appear benign based on the failure codes generated by the diagnostic systems; however, failure to detect and resolve the underlying combustion gas leak can eventually result in failure of the engine and associated systems.

Prior attempts at diagnosing combustion gas leakage in a combustion engine have been directed to methods of confirming a combustion gas leak after the leak is already suspected. For example, U.S. Pat. No. 4,667,507 discloses a method of testing the sealing integrity of the engine by running the engine until a normal operating temperature is achieved, venting pressure inside the coolant system to atmospheric pressure by opening a valve fluidly connected between the coolant system and atmosphere, closing the valve, and then running the engine again for a predetermined test period while measuring the pressure within the coolant system.

Such systems and methods described above for confirming suspected combustion gas leaks, are both time consuming and costly, requiring the work machine to be out of service during testing. Consequently, there remains a need for an improved combustion leak detection and diagnostic strategy for work machines.

SUMMARY

In accordance with one aspect of the present disclosure, a work machine with a remote diagnostic system is disclosed. The work machine may include a combustion engine and a pump driven by the engine. The pump may include an inlet and an outlet. The work machine may also include a coolant temperature sensor and a pressure sensor. The coolant temperature sensor may be configured to monitor and transmit a coolant fluid temperature. The pressure sensor may be coupled to the inlet of the pump, and may monitor and transmit a coolant fluid pressure at the inlet of the pump. A controller, including a processor, may be operatively associated with the engine, the coolant fluid temperature sensor, the pressure sensor and an equipment care advisor module. The equipment care advisor module may also include a processor and may be configured to monitor the coolant fluid temperature during a start-up of the work machine, to monitor the coolant fluid pressure during the start-up of the work machine, to calculate an expected coolant fluid pressure based on the monitored coolant fluid temperature and the monitored coolant fluid pressure, and to generate a failure code indicating a combustion gas leak into a cooling system of the engine when the monitored coolant fluid pressure exceeds the expected coolant fluid pressure.

In accordance with another aspect of the present disclosure, a remote diagnostic system for a plurality of work machines is disclosed. Each work machine may include at least an engine and a controller. The remote diagnostic system may include a display module and an equipment care advisor module. The display module may include at least one display device and at least one user input device. The equipment care advisor module may include a processor, and may be electronically coupled to each controller of each work machine. Furthermore, each controller may be electronically coupled to a coolant temperature sensor and a coolant pressure sensor. For each work machine, the equipment care advisor module may monitor a coolant fluid temperature measured by the coolant temperature sensor during a start-up period, monitor a coolant fluid pressure measured by the coolant pressure sensor during the start-up period, calculate an expected coolant fluid pressure based on the monitored coolant fluid temperature and the monitored coolant fluid pressure, and generate a failure code indicating a combustion gas leak when the monitored coolant fluid pressure exceeds the expected coolant fluid pressure.

In accordance with yet another aspect of the present disclosure, method of detecting a combustion gas leak in an engine of a work machine is disclosed. The work machine may include an engine and a coolant pump. The method may include starting the engine. The engine may have a start-up period corresponding to a predetermined period of time. The method may further include monitoring, for the duration of the start-up period, a coolant fluid temperature and a coolant fluid pressure. The method further includes calculating an expected coolant fluid pressure based on the monitored coolant fluid temperature and the monitored coolant fluid pressure, and comparing the monitored coolant fluid pressure to the expected coolant fluid pressure. Finally, the method includes generating a failure code when the monitored coolant fluid pressure exceeds the expected coolant fluid pressure, the failure code indicating combustion gas created in the engine is leaking out of the engine.

These and other aspects and features of the present disclosure will be better understood upon reading the following detailed description, when taken in conjunction with the accompanying drawings.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts.

Figure 1:
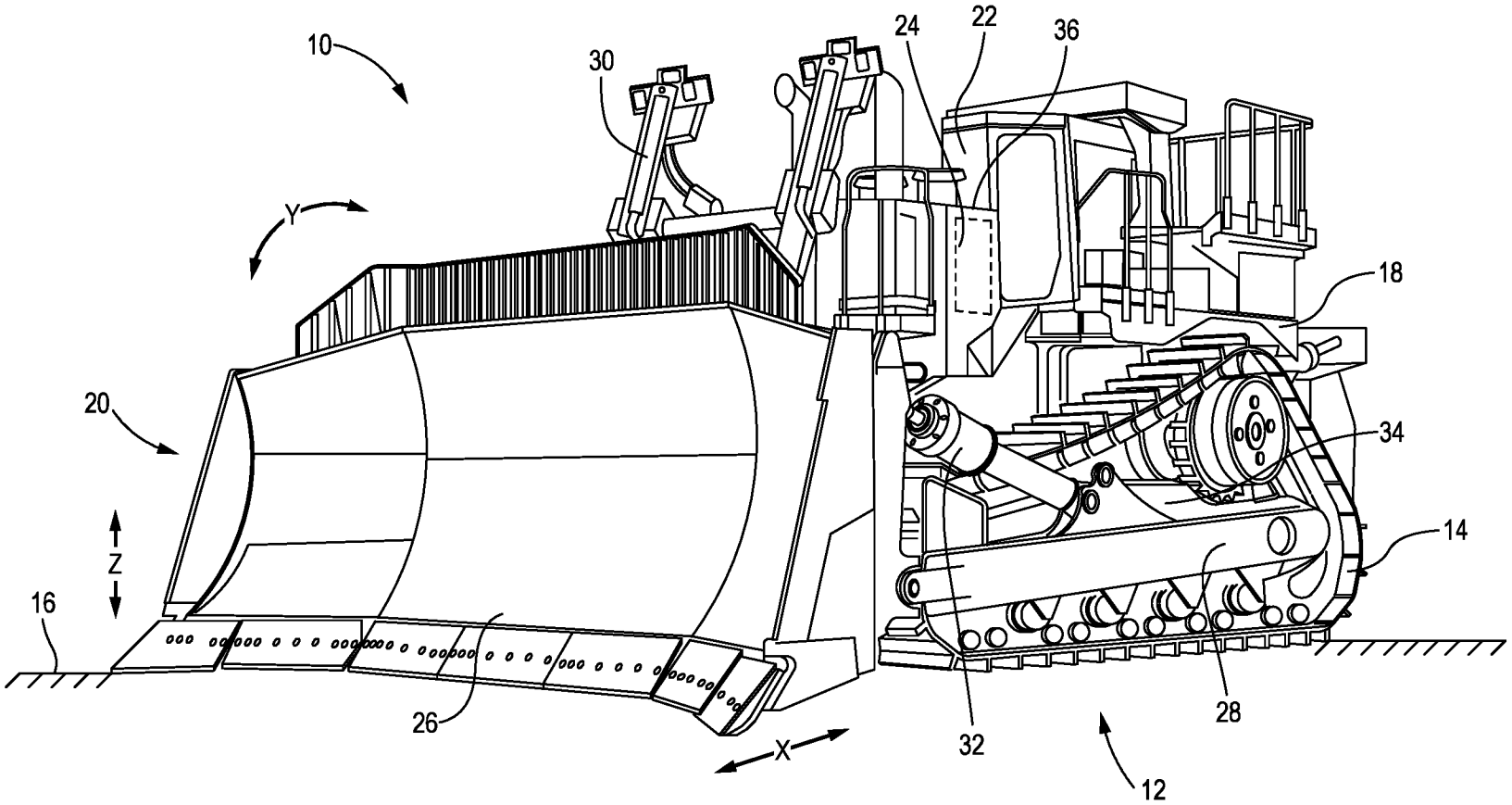
FIG. 1 is a side perspective view of a work machine, in accordance with an embodiment of the present disclosure.

FIG. 1 illustrates a side perspective view of a work machine 10, according to an embodiment of the present disclosure. The exemplary work machine 10, as illustrated, may be a fixed or mobile machine, such as a track type tractor, although the features disclosed herein may be utilized with other types of machines, such as backhoes, compactors, excavators, dozers, loaders, motor graders, and other earth moving machines. The illustrated work machine 10 includes an undercarriage 12 with one or more ground engaging mechanisms 14 configured to engage with a ground surface 16 of a worksite and to move the work machine along the ground surface. While the present work machine 10 is illustrated with a pair of endless track assemblies, the ground engaging mechanisms 14 may be of any suitable type, including wheels.

The undercarriage 12 may support a main frame 18. The main frame 18 may support various components of the work machine 10, including an implement system 20, an operator cab 22 and a combustion engine 24. The implement system 20 may include a work implement 26, one or more push arms 28, one or more hydraulic lift cylinders 30, and one or more hydraulic tilt cylinders 32. While the present work implement 26 is illustrated as a blade, the work implement may include any suitable tool or attachment, such as, for example, a bucket, a ripper, a compactor, forks, a plow, a trencher, or any other known implement configured to collect, hold and transport material and/or heavy objects at the worksite. The work implement 26 may be connected to the main frame 18 and/or the undercarriage 12 by at least one of the push arms 28, the lift cylinders 30, and/or the tilt cylinders 32. Alternatively, the work implement 26 may be connected to the main frame 18 by a power angle tilt (or "PAT") arrangement (not shown). The push arms 28 may be coupled at one end to a roller frame 34 of the undercarriage 12, and coupled at an opposite end to the work implement 26 to stabilize the work implement as the work machine 10 travels in the X direction. The hydraulic lift cylinders 30 may configured to move the work implement in the Z direction, and the hydraulic tilt cylinders 32 may be configured to move the work implement in the Y direction. The push arms 28, lift cylinders 30 and tilt cylinders 32 may be configured to effectuate the movement of the work implement 26 based on operator commands received through various input devices (not shown) disposed within the operator cab 22. Further, the engine 24 may provide power to the ground engaging mechanisms 14, the implement system 20, a cooling system 100 (FIG. 2), a hydraulic system (not shown) and various other components of the work machine 10.

The engine may be, for example, a diesel engine, a gasoline engine, a gaseous fuel engine, or any other type of combustion engine. The engine may be enclosed and protected by an engine hood 36 of the work machine 10. The engine 24 may also be coupled to the cooling system 100 (FIG. 2) that may also be at least partially housed with the engine hood 36. The cooling system may be configured to cool the engine and various other components (e.g. the transmission system (not shown)) of the work machine 10.

Figure 2:
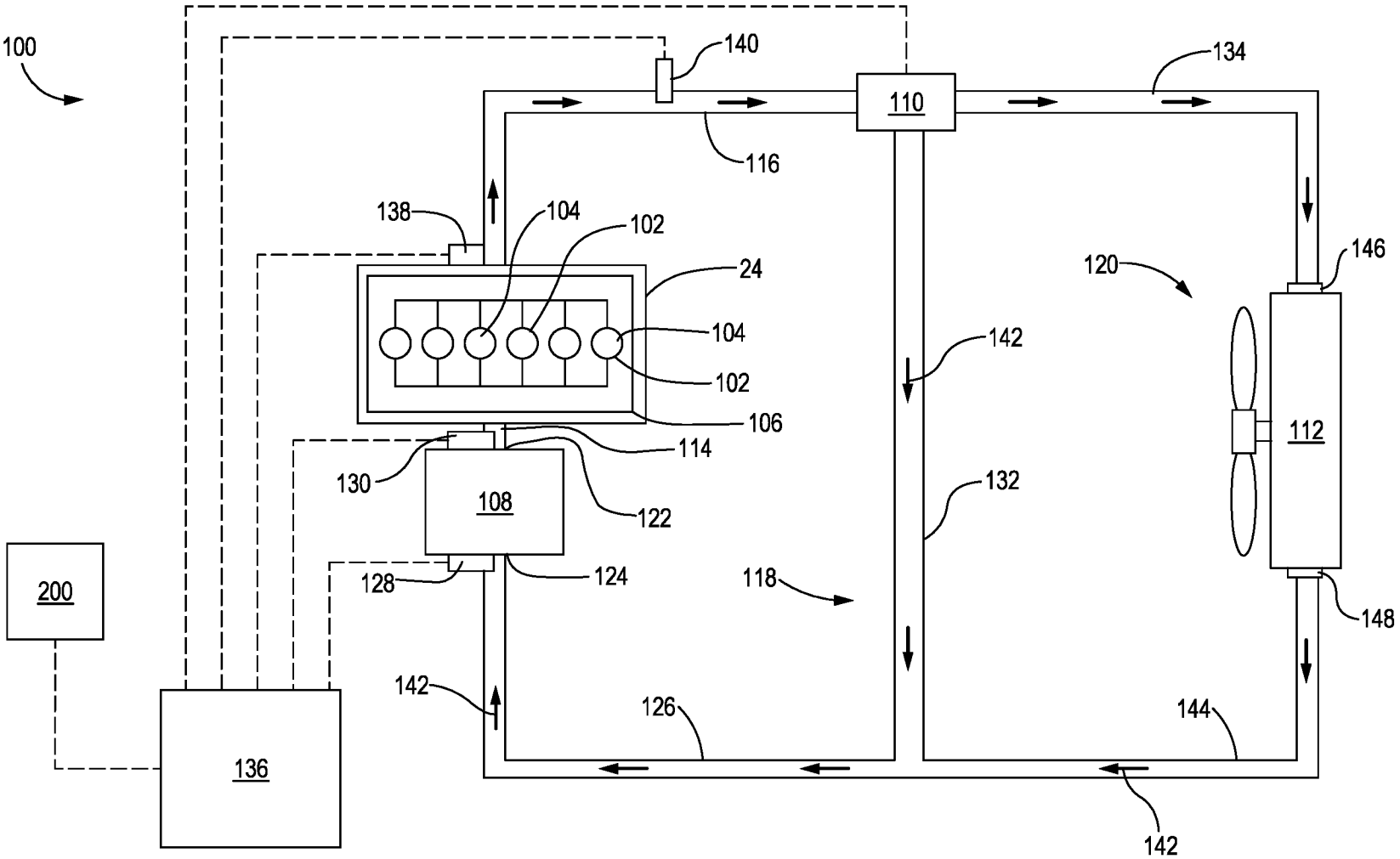
FIG. 2 is a schematic illustration of an engine cooling system, in accordance with an embodiment of the present disclosure.

FIG. 2 illustrates a schematic representation of an exemplary engine cooling system 100, which may be used to maintain stable engine temperatures of the work machine 10 under varying operating conditions. The engine 24 may be a combustion engine including a plurality of cylinders 102, and each cylinder 102 may define a combustion chamber 104 therein. The cylinders 102 may be arranged in-line, in a V-type confirmation, or in another configuration as is known in the art. Each combustion chamber 104 may receive a fuel or an air-fuel mixture that is ignited to execute a power stroke to generate a desired power output for the work machine 10.

Combustion of the fuel or air-fuel mixture generates heat within the engine 24. Consequently, the engine cooling system 100 may be configured to dissipate the heat generated within the engine 24 by circulating a coolant fluid within the engine 24. The coolant may be a liquid, and may include, for example, water, ethylene glycol, and other suitable solutions. To facilitate coolant flow within the engine 24, the engine 24 may include an engine cooling jacket 106 with a plurality of fluid passageways. While illustrated schematically in FIG. 2 as surrounding an outer perimeter of the engine 24, in a preferred embodiment of the present invention, the engine cooling jacket 106 may also or alternatively surround an exterior of each individual cylinder 102. By positioning the engine cooling jacket 106 proximate the combustion chambers 104, as well as maximizing the surface area of the cylinder 102 in contact with the engine cooling jacket, the temperature of the engine 24 may be more accurately regulated.

The engine cooling system 100 may also include a coolant pump 108, a thermostat valve 110, and a radiator 112. The coolant pump 108 may be driven by the engine 24 to circulate the coolant through the engine cooling system 100. Generally, the coolant may flow from the pump 108 through the engine cooling jacket 106 of the engine 24, and subsequently through various conduits that circulate the coolant back to the pump. The direction of coolant flow is illustrated in FIG. 2 by arrows 142. More specifically, the pump 108 may include a pump outlet 122 and a pump outlet conduit 114 fluidly coupled to the engine cooling jacket 106 and configured to facilitate flow of the coolant from the pump to the engine cooling jacket. After circulating through the engine 24 via the engine cooling jacket 106, the coolant may exit the engine via an engine outlet conduit 116 that may be fluidly coupled to the thermostat valve 110. The coolant may then be recirculated back to the pump 108 via a bypass flow path 118 and/or a radiator flow path 120, which will be explained in greater detail below. Regardless of the flow path, as the coolant is recirculated back to the pump 108, the coolant may enter the pump at a pump inlet 124 via a pump inlet conduit 126.

The pump 108 may further include an inlet pressure sensor 128 associated with the pump inlet 124 and configured to monitor a pressure P1 of the coolant as it enters the pump via the pump inlet conduit 126. An outlet pressure sensor 130 may be associated with the pump outlet 122 and configured to monitor a pressure P2 of the coolant as it exits the pump via the pump outlet conduit 114. The inlet pressure sensor 128 and outlet pressure sensor 130 may consist of any conventionally known pressure sensors capable of measuring fluid pressure.

Both the inlet pressure sensor 128 and outlet pressure sensor 130 may be in electronic communication with a controller 136, and may transmit data signals, readings, and/or sensed measurements electronically for processing at the controller. The controller 136 may also be in electronic communication with an engine speed sensor 138 associated with the engine 24 and configured to measure a speed of the engine, a coolant temperature sensor 140 positioned in the engine outlet conduit 116 and configured to measure a temperature of the coolant, as well as the thermostat valve 110. Like the inlet pressure sensor 128 and the outlet pressure sensor 130, the engine speed sensor 138 and coolant temperature sensor 140 may also transmit data signals, readings, and/or sensed measurements electronically for processing at the controller.

More specifically, the coolant temperature sensor 140 may include any type of device(s) or any type of component(s) that may sense (or detect) a temperature of the coolant. While a single coolant temperature sensor 140 is illustrated in FIG. 2, multiple temperature sensors may also be utilized. In the illustrated embodiment, the coolant temperature sensor 140 is positioned downstream of the engine 24 and upstream from the thermostat valve 110. Preferably, the coolant temperature sensor 140 may directly contact the flow of coolant. However, it will be appreciated that, in an alternate embodiment, the temperature of the coolant may be measured without direct contact between coolant temperature sensor 140 and the coolant fluid.

The controller 136 may include any type of device or any type of component that may interpret and/or execute information and/or instructions stored within a memory to perform one or more functions. The memory may include a random access memory ("RAM"), a read only memory ("ROM"), and/or another type of dynamic or static storage device (e.g., a flash, magnetic, or optical memory) that stores information and/or instructions for use by the controller 136. Additionally, or alternatively, the memory may include non-transitory computer-readable medium or memory, such as a disc drive, flash drive, optical memory, read-only memory (ROM), or the like. The memory may store the information and/or the instructions in one or more data structures, such as one or more databases, tables, lists, trees, etc. The controller 136 may also include a processor (e.g., a central processing unit, a graphics processing unit, an accelerated processing unit), a microprocessor, and/or any processing logic (e.g., a field-programmable gate array ("FPGA"), an application-specific integrated circuit ("ASIC"), etc.), and/or any other hardware and/or software. The controller 136 may transmit data via a network (not shown). For example, the controller 136 may be configured to provide output to one or more display units (not shown) that may be visible by the operator of the work machine 10, but may also be configured to provide output to external system, such as a remote diagnostic system 200, which may be electronically coupled to a plurality of controllers associated with a plurality of work machines and other vehicles. In this regard, data associated with each work machine may be stored in a central location and may be accessible by machine operators, technicians, data analysts, and others, as needed.

As mentioned above, the engine cooling system 100 may include a thermostat valve 110 positioned at a junction of the engine outlet conduit 116, a bypass conduit 132 and a radiator inlet conduit 134. The thermostat valve 110 may be configured to regulate the flow of the coolant from the engine 24 toward either or both of the bypass flow path 118 and the radiator flow path 120 based on one or more engine parameters. The engine parameters may include, for example, the speed of the engine 24, as measured by the engine speed sensor 138, and the temperature of the coolant, as measured by the coolant temperature sensor 140. The thermostat valve 110 may be any conventionally known thermostat that includes an electrically assisted valve element (not shown) having a thermally sensitive element, such as wax. The controller 136 may thus cause the valve element of the thermostat valve 110 to open or close based on the one or more engine parameters. The valve position of the thermostat valve 110 may vary between a fully open position, a fully closed position, and a myriad of intermediate partially open or partially closed positions to finely tune the distribution of coolant to the bypass flow path 118 and the radiator flow path 120, as explained more specifically below.

At low coolant temperatures, for example, such as upon startup of the work machine 10, the thermostat valve 110 may direct coolant through the bypass flow path 118, which, as illustrated in FIG. 2, is defined by the bypass conduit 132 and the pump inlet conduit 126. In this example, the thermostat valve 110 may be in a first thermostat position, such as a fully closed position. The thermostat valve 110, in the fully closed position, may block the coolant flow toward the radiator 112, and instead direct the coolant flow along the bypass conduit 132 and back toward the pump 108. In one embodiment, the thermostat valve 110 may operate in the fully closed position when the controller 136 determines the coolant temperature measured by the coolant temperature sensor 140 is below a first threshold temperature T1.

Conversely, at higher coolant temperatures, for example, the thermostat valve 110 may direct coolant through the radiator flow path 120, which as illustrated in FIG. 2, is defined by the radiator inlet conduit 134, a radiator outlet conduit 144, and the pump inlet conduit 126. In this example, the thermostat valve 110 may be in a second thermostat position, such as a fully open position. The thermostat valve 110, in the fully open position, may block coolant flow along the bypass conduit 132, and instead direct the coolant toward the radiator 112 along the radiator inlet conduit 134. In one embodiment, the thermostat valve 110 may operate in the fully open position when the controller 136 determines the coolant temperature measured by the coolant temperature sensor 140 is above a second threshold temperature T2. It may be contemplated that the second threshold temperature value T2 is greater than the first threshold temperature T1.

Furthermore, the controller 136 is configured to shift the thermostat valve 110 into various partially open or partially closed positions when the controller determines the coolant temperature, as measured by the coolant temperature sensor 140, is greater than or equal to the first threshold temperature T1 and less than or equal to the second threshold temperature T2. In this situation, for example, coolant may flow through both the bypass flow path 118 and the radiator flow path 120, thereby creating a parallel flow path, as illustrated in FIG. 2.

The radiator 112 includes a radiator inlet 146 configured to be fluidly connected to the engine outlet conduit 116 and the thermostat valve 110 via the radiator inlet conduit 134. The radiator 112 further includes a radiator outlet 148 configured to be fluidly connected to the pump inlet conduit 126 via the radiator outlet conduit 144. In operation, the heated coolant exits the engine 24 and is directed by the thermostat valve 110 toward the radiator 112. As the coolant flows through the radiator, the temperature of the coolant is reduced or cooled. The cooled coolant exits the radiator through the radiator outlet 148, and is directed back toward the pump 108 via the radiator outlet conduit 144 and the pump inlet conduit 126.

As noted above, the controller 136 is configured to determine the one or more engine parameters, such as engine speed and coolant temperature. In this regard, measurements taken by the engine speed sensor 138 and coolant temperature sensor 140 may be communicated to, and received by, the electronic controller 136. Further, the controller 136 may be configured to determine a pressure difference between the pump inlet pressure P1 and the pump outlet pressure P2. In this regard, measurements taken by the pump inlet pressure sensor 128 and pump outlet pressure sensor 130 may be communicated to, and received by, the electronic controller 136. Upon receipt of the pressure values P1 and P2, the controller 136 may calculate the pressure difference between P1 and P2 to determine the pressure difference. Moreover, the controller 136 may be configured to determine a change in pump inlet pressure over a period of time ($\Delta P_{in}$).

Monitoring the engine parameters as well as the coolant fluid pressure is not only essential in maintaining optimal performance of the engine 24, but is also crucial to diagnose a combustion gas leak and prevent damage to the engine or work machine 10. When improperly monitored, an undetected combustion gas leak may critically damage the engine 24 and other associated components of the work machine 10. To prevent such damage, the controller 136 of the work machine 10 may be in electronic communication via a network (not shown) with a remote diagnostic system 200, which may be configured to monitor at least the coolant temperature, the pump inlet pressure P1, the pump outlet pressure P2, the pump inlet pressure differential $\Delta P_{in}$, and the speed of the engine 24 to determine, before damage can occur, whether combustion gas may be leaking into the cooling system 100.

Figure 3:
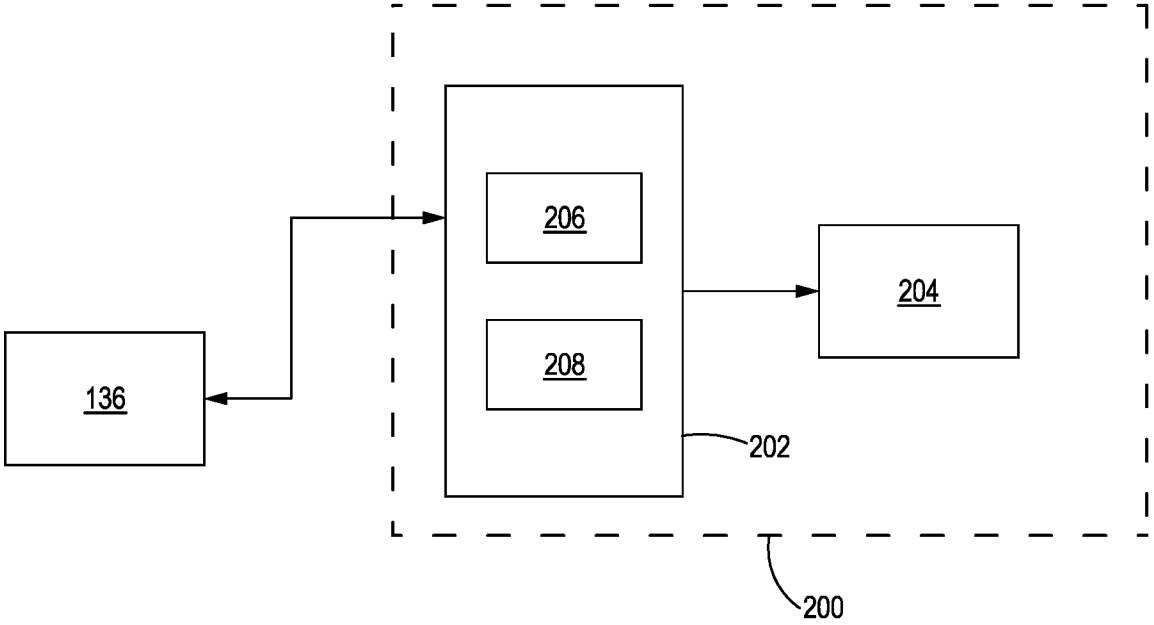
FIG. 3 is a schematic illustration of a remote diagnostic system, in accordance with an embodiment of the present disclosure.

As illustrated in FIG. 3, with continued reference to FIGS. 1 and 2, the remote diagnostic system 200 and the included and/or associated components thereof, is configured to continuously monitor, process, and determine, in part, the performance and operating condition of the work machine 10, to determine whether a combustion gas leak is occurring, in real time, and to generate a failure code indicating the combustion gas leak. More specifically, the remote diagnostic system 200 includes an equipment care advisor module 202 and a display module 204. The equipment care advisor module 202 may be in electronic communication with both the controller 136 associated with the work machine 10 and the display module 204, and may include at least a memory 206 and a processor 208, as similarly described above in relation to the controller 136. More specifically, the equipment care advisor module 202 may include any type of device or any type of component that may interpret and/or execute information and/or instructions stored with the memory 206 to perform one or more functions. For example, the equipment care advisor module 202 may use data received from the coolant temperature sensor 140, the engine speed sensor 138, the pump inlet pressure sensor 128 and the pump outlet pressure sensor 130 of the work machine 10 to determine whether a combustion gas leak is occurring by calculating a rate of change in pump pressure over a predetermined period of time, calculating a rate of change in coolant temperature over the same predetermined period of time, and comparing the rate of change in pump pressure and the rate of change in coolant temperature to predetermined threshold values.

The display module 204 may include at least a display (not shown) and at least one input device (not shown), such as a keyboard and mouse. Other types of displays, such as, for example, a hand held computing device, voice recognition means, a touch screen, or the like, are also contemplated. Accordingly, the equipment care advisor module 202 may also transmit received data, as well as calculated values (such as the rate of change in pump pressure and coolant temperature) to the display module 204 for viewing by those with access to the remote diagnostic system 200. While not shown, the remote diagnostic system 200 may also include at least one data storage device (e.g., a database), and may be electronically coupled to a plurality of controllers associated with a plurality of work machines and other vehicles, such that data associated with each work machine may be stored in a central location and may be accessible by machine operators, technicians, data analysts, and others, as needed.

As discussed above and further discussed herein, the remote diagnostic system 200, and the included and/or associated components thereof, including, in part, the equipment care advisor module 202, is configured to continuously monitor, process, and determine, in part, the performance, operating condition, and/or failure of components of the work machine 10. The remote diagnostic system 200 is therefore configured to provide a failure code, in real time, to a user of the remote diagnostic system, when a combustion gas leak is detected, as determined by the equipment care advisor module 202. In providing such failure code, the remote diagnostic system 200, and equipment care advisor module 202 thereof, can provide an operator and/or technicians accessing the work machine 10 with the opportunity to take appropriate responsive actions, including, but not limited to, actions relating to the operation of the work machine. Responsive actions may be necessary to prevent damage to the engine 24, as well as any associated components of the cooling system 100 and the work machine 10. Providing such failure code from the remote diagnostic system 200 may further provide the operator and/or user of user of the remote diagnostic system with the opportunity to coordinate, plan, and/or schedule timely procurement and deployment of maintenance services and/or personnel to ensure replacement of defective or damaged components as necessary to prevent any machine downtime or loss in productivity.

INDUSTRIAL APPLICABILITY

In practice, the present disclosure finds utility in various industrial applications, including, but not limited to, construction, paving, transportation, mining, industrial, earthmoving, agricultural, and forestry machines and equipment. For example, the present disclosure may be applied to compacting machines, paving machines, dump trucks, mining vehicles, on-highway vehicles, off-highway vehicles, earth-moving vehicles, agricultural equipment, material handling equipment, and/or any work machine including an electronically controlled combustion engine. More particularly, the present disclosure provides a remote diagnostic system 200 with an equipment care advisor module 202 to ultimately detect a combustion gas leak into a cooling system.

Figure 4:
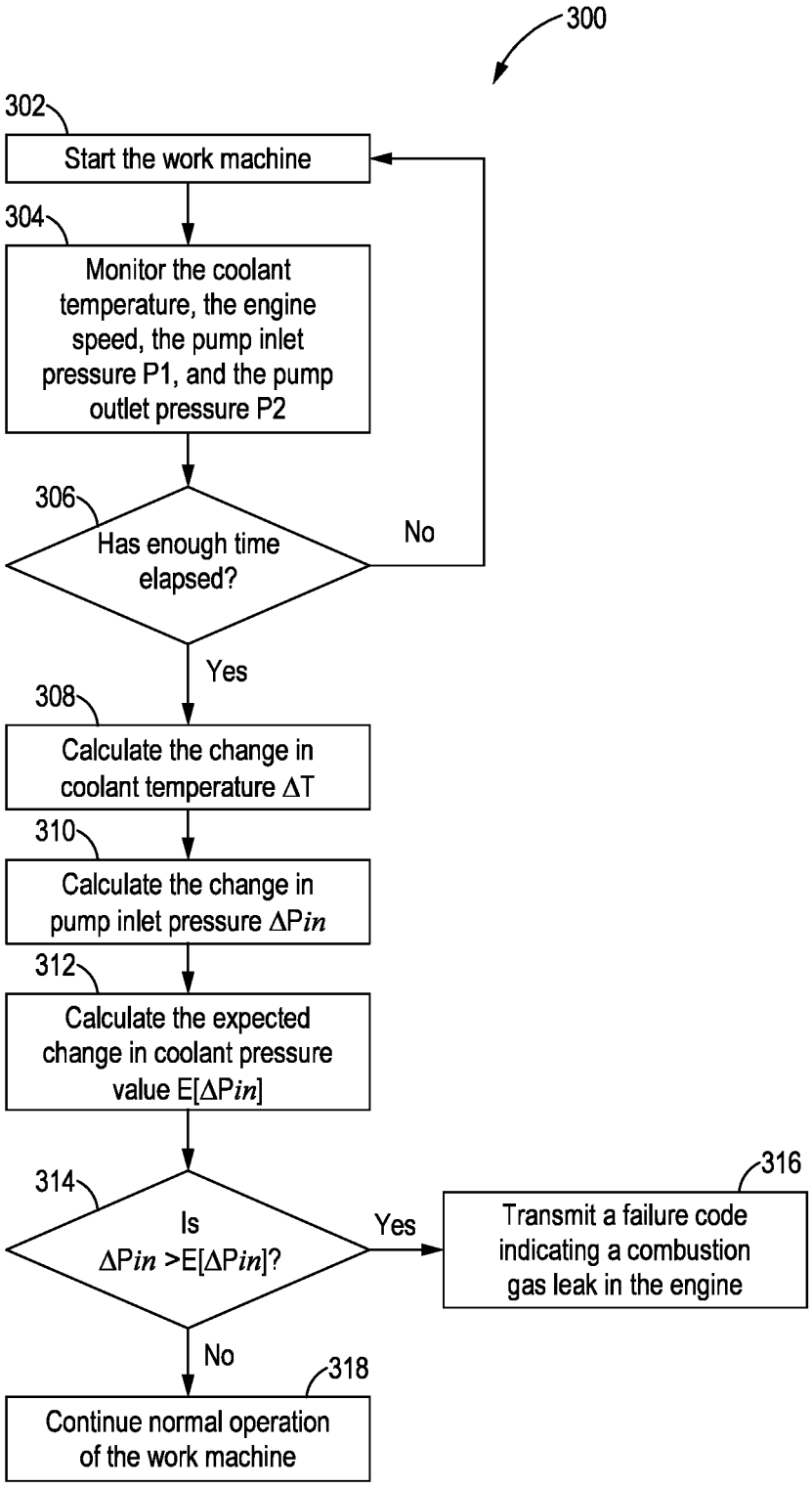
FIG. 4 is a flowchart illustrating a method of managing engine power of a work machine, in accordance with an embodiment of the present disclosure.

A series of steps 300 involved in detecting a combustion gas leak into the cooling system 100 of the work machine 10 is illustrated in flowchart format in FIG. 4. Continued reference will also be made to elements illustrated in FIGS. 1-3. As illustrated in FIG. 5, in a first step 302, the engine 24 of the work machine 10 may be started and idled for a predetermined period of time. The predetermined period of time may correspond to an engine start-up or warm-up period, for example, approximately 10 minutes. The predetermined period of time may vary pursuant to an outdoor or ambient temperature. In that regard, the engine start-up period for the work machine may be longer in colder ambient temperatures and shorter in warmer ambient temperatures.

At step 304, while the work machine 10 remains idling, the coolant temperature, the engine 24 speed, the pump inlet pressure P1 and the pump outlet pressure P2 may be monitored by the remote diagnostic system 200. More specifically, the coolant temperature sensor 140, the engine speed sensor 138, the pump inlet pressure sensor 128 and the pump outlet pressure sensor 130 may transmit the sensed data to the controller 136 associated with the work machine 10. The controller 136 may then transmit the data to the remote diagnostic system 200. While the present disclosure utilizes coolant pressures and temperatures and engine speed, it should be noted and appreciated that additional data, such as air temperature, engine load, fuel temperatures and other data may also be monitored and analyzed in the same manner described herein. The coolant temperature, the engine 24 speed, the pump inlet pressure P1 and the pump outlet pressure P2 may ultimately be received by the equipment care advisor module 202 and stored in the memory 206 associated therewith. Alternatively, this data may be stored in a storage unit not illustrated in FIG. 3, such as, for example, a database or cloud-based storage unit.

If, at a next step 306, the equipment care advisor module 202 determines that not enough time has elapsed with respect to the predetermined period of time for engine start-up, steps 304 and 306 will repeatedly execute until the equipment care advisor module determines that the start-up period has elapsed. Once the predetermined period of time for engine start-up has fully elapsed, a step 308 may be executed.

At step 308, a change in coolant temperature over the engine start-up period, hereinafter $\Delta T$, may be calculated. Specifically, the equipment care advisor module 202 may retrieve both the coolant temperature $T_1$ as it was sensed by the coolant temperature sensor 140 at the end of the start-up period and the coolant temperature $T_0$ as it was sensed by the coolant temperature sensor at the time the engine 24 was started from its memory 206. The final coolant temperature $T_1$ may be subtracted from the initial coolant temperature $T_0$ to calculate the $\Delta T$ value, which indicates by how many degrees the coolant temperature rose or fell during the engine start-up period.

At step 310, a change in pump inlet pressure, hereinafter $\Delta P_{in}$ may be calculated. Specifically, the equipment care advisor module 202 may retrieve both the pump inlet pressure $P1_1$ as it was sensed by the pump inlet pressure sensor 128 at the end of the start-up period and the pump inlet pressure $P1_0$ as it was sensed by the pump inlet pressure sensor at the time the engine 24 was started from its memory 206. The equipment care advisor module 202 may subtract the final pump inlet pressure $P1_1$ from the initial pump inlet pressure $P1_0$ to determine the $\Delta P_{in}$ value, which indicates by how many kilopascals (kPa) the pump inlet pressure rose or fell during the engine start-up period.

Using the change in coolant temperature $\Delta T$ value calculated at step 308, the equipment care advisor module 202 may then (at step 312) calculate an expected change in coolant pressure value, hereinafter $E[\Delta P_{in}]$. Using volumetric thermal expansion principals known in the art, the equipment care advisor module 202 may calculate $E[\Delta P_{in}]$ using the initial pump inlet pressure $P1_0$, the initial coolant temperature $T_0$ and the final coolant temperature $T_1$ values, as well as the predetermined period of time given for the start-up period.

At step 314, the equipment care advisor module 202 may compare the actual change in pump inlet pressure $\Delta P_{in}$ with the calculated expected change in pump inlet pressure $E[\Delta P_{in}]$ to determine whether the coolant pressure is increasing too quickly in relation to the change in coolant temperature. For example, assume an initial coolant temperature $T_0$ of approximately 83° C., a final coolant temperature $T_1$ of approximately 93° C., an initial pump inlet pressure $P1_0$ of approximately 20 kPa, a final pump inlet pressure $P1_1$ of approximately 120 kPa, and a predetermined engine start-up period of approximately 6 minutes. The change in coolant temperature $\Delta T$ would be approximately 10° C., while the change in pump inlet pressure $\Delta P_{in}$ would be approximately 100 kPa. The expected change in pump inlet pressure $E[\Delta P_{in}]$ over that predetermined engine start-up period of 6 minutes, with a 10° C. increase in coolant temperature should have been approximate 20 kPa. In this example, the work machine should be parked immediately, as the expected change in pump inlet pressure $E[\Delta P_{in}]$ is far lower than the actual change in pump inlet pressure $\Delta P_{in}$, indicating a combustion gas leak into the engine cooling system.

If the equipment care advisor module 202 determines the actual change in pump inlet pressure $\Delta P_{in}$ is greater than the expected change in pump inlet pressure $E[\Delta P_{in}]$, then the work machine 10 may be operating with an active combustion gas leak. Upon making this determination, the equipment care advisor module 202 may transmit a failure code to the display module 204 (step 316). More specifically, the equipment care advisor module 202 may command the display module 204 to communicate via prominent visual and/or audial indication to a user of the remote diagnostic system 200 that the work machine 10 has a combustion gas leak into its engine cooling system 100. An audial indicator or warning may include an alarm, buzzing, and similar sounds optimized to gain the attention of the user of the remote diagnostic system 200. Visual warnings may include simply illuminating a light on the display of the display module 204, or may include displaying symbols, graphics or text that not only informs the user of the warning, but also instructs the user to take specific actions.

In an alternative embodiment, the equipment care advisor module 202 may only transmit the failure code to the display module 204 when the actual change in pump inlet pressure $\Delta P_{in}$ exceeds the expected change in pump inlet pressure $E[\Delta P_{in}]$ by a predetermined threshold amount, for example, 50 kPa. Returning to the example provided above, the actual change in pump inlet pressure $\Delta P_{in}$ exceeded the expected change in pump inlet pressure $E[\Delta P_{in}]$ by approximately 100 kPa. As such, in that case, a failure code would still be transmitted to the display module 204 as it exceeds the predetermined 50 kPa threshold amount.

If the equipment care advisor module 202 determines the actual change in pump inlet pressure $\Delta P_{in}$ is less than or equal to the expected change in pump inlet pressure $E[\Delta P_{in}]$, then the work machine 10 may continue to be operated normally. At step 318, therefore, no action may be taken by the equipment care advisor module 202, and the work machine 10 may simply be allowed to proceed under its normal operating conditions.

While a series of steps and operation have been described herein, those skilled in the art will recognize that these steps and operations may be re-arranged, replaced, eliminated, performed simultaneously and/or performed continuously without departing from the spirit and scope of the present disclosure as set forth in the claims.

With implementation of the present disclosure, service technicians and operators of work machines may be alerted to a combustion gas leak before a catastrophic failure occurs, not in response to it. With early warning and an automated system designed to protect the engine and other components of the work machine, service technicians and operators of a given work machine may be able to use that warning to plan maintenance, overhaul, and/or other service routines on the engine or work machine in a timely manner with little or no obstruction to an ongoing job on a worksite.

While aspects of the present disclosure have been particularly shown and described with reference to the embodiments above, it will be understood by those skilled in the art that various additional embodiments may be contemplated by the modification of the disclosed machines, systems and assemblies without departing from the scope of what is disclosed. Such embodiments should be understood to fall within the scope of the present disclosure as determined based upon the claims and any equivalents thereof.

What is claimed is:

1. A work machine with a remote diagnostic system, the work machine comprising:

a combustion engine;

a pump driven by the engine and having an inlet and an outlet;

a coolant temperature sensor configured to monitor and transmit a coolant fluid temperature;

a pressure sensor coupled to the inlet of the pump, the pressure sensor configured to monitor and transmit a coolant fluid pressure at the inlet of the pump; and a controller, including a processor, operatively associated with the engine, the coolant fluid temperature sensor, the pressure sensor and an equipment care advisor module, the equipment care advisor module including a processor and being configured to:

monitor the coolant fluid temperature during a start-up of the work machine, monitor the coolant fluid pressure during the start-up of the work machine, calculate an expected coolant fluid pressure based on the monitored coolant fluid temperature and the monitored coolant fluid pressure, and generate a failure code indicating a combustion gas leak into a cooling system of the engine when the monitored coolant fluid pressure exceeds the expected coolant fluid pressure.

2. The work machine of claim 1, wherein the equipment care advisor module is further configured to transmit the failure code to a display module of the remote diagnostic system, the display module including at least one display device and at least one user input device.

3. The work machine of claim 2, wherein the display module communicates the failure code through the at least one display device to a user of the remote diagnostic system via one or more of a visual and audial indication.

4. The work machine of claim 1, wherein when the monitored coolant fluid pressure is less than or equal to the expected coolant fluid pressure, the work machine operates under normal operating conditions.

5. The work machine of claim 1, wherein the coolant temperature sensor is fixed to an engine outlet conduit configured to carry coolant fluid away from the engine, the coolant temperature sensor being at least partially submerged in the coolant fluid.

6. The work machine of claim 1, wherein the equipment care advisor module is further configured to generate the failure code when the monitored coolant fluid pressure exceeds the expected coolant fluid pressure by a predetermined pressure threshold.

7. A remote diagnostic system for a work machine, the work machine including an engine and a controller, the remote diagnostic system comprising:

a display module including at least one display device and at least one user input device; and an equipment care advisor module, including a processor, electronically coupled to the controller, the controller being electronically coupled to a coolant temperature sensor and a coolant pressure sensor, the equipment care advisor module being configured to:

monitor a coolant fluid temperature measured by the coolant temperature sensor during a start-up period, monitor a coolant fluid pressure measured by the coolant pressure sensor during the start-up period, calculate an expected coolant fluid pressure based on the monitored coolant fluid temperature and the monitored coolant fluid pressure, and generate a failure code indicating a combustion gas leak when the monitored coolant fluid pressure exceeds the expected coolant fluid pressure.

8. The remote diagnostic system of claim 7, wherein the coolant temperature sensor is fixed to an engine outlet conduit configured to carry coolant fluid away from the engine, the coolant temperature sensor being at least partially submerged in the coolant fluid.

9. The remote diagnostic system of claim 7, wherein the equipment care advisor module is further configured to generate the failure code when the monitored coolant fluid pressure exceeds the expected coolant fluid pressure by a predetermined pressure threshold.

10. The remote diagnostic system of claim 7, wherein each controller is further configured to transmit to the equipment care advisor module an initial coolant fluid temperature measured by the coolant temperature sensor at the beginning of the start-up period and a final coolant fluid temperature measured by the coolant temperature sensor at the conclusion of the start-up period.

11. The remote diagnostic system of claim 10, wherein each controller is further configured to transmit to the equipment care advisor module an initial coolant fluid pressure measured by the coolant pressure sensor at the beginning of the start-up period and a final coolant fluid pressure measured by the coolant pressure sensor at the conclusion of the start-up period.

12. The remote diagnostic system of claim 11, wherein the equipment care advisor module is further configured to calculate the expected coolant fluid pressure using the initial coolant fluid temperature, the final coolant fluid temperature, the initial coolant fluid pressure, and a duration of the start-up period.

13. The remote diagnostic system of claim 7, wherein the equipment care advisor module is further configured to transmit the failure code to the display module.

14. The remote diagnostic system of claim 13, wherein the display module communicates the failure code through the at least one display device to a user of the remote diagnostic system via at least one of a visual indication and an audial indication.

15. A method of detecting a combustion gas leak in an engine of a work machine, the work machine including an engine and a coolant pump, the method comprising:

starting the engine, the engine having a start-up period corresponding to a predetermined period of time;

monitoring, for the duration of the start-up period, a coolant fluid temperature;

monitoring, for the duration of the start-up period, a coolant fluid pressure;

calculating an expected coolant fluid pressure based on the monitored coolant fluid temperature and the monitored coolant fluid pressure;

comparing the monitored coolant fluid pressure to the expected coolant fluid pressure; and generating a failure code when the monitored coolant fluid pressure exceeds the expected coolant fluid pressure, the failure code indicating combustion gas created in the engine is leaking out of the engine.

16. The method of claim 15, further including monitoring, for the duration of the start-up period, an engine speed, an engine load, a second pressure of the coolant fluid of the work machine and an ambient temperature, the second pressure of the coolant fluid being measured by a second pressure sensor positioned proximate an outlet of the coolant pump.

17. The method of claim 16, wherein the calculating the expected coolant fluid pressure is further based on the monitored engine speed, the monitored engine load, the monitored second pressure of the coolant fluid, and the monitored ambient temperature.

18. The method of claim 15, further including generating the failure code when the monitored coolant fluid pressure exceeds the expected coolant fluid pressure by a predetermined pressure threshold.

19. The method of claim 15, further including transmitting the failure code to a display device; and displaying the failure code via at least one of a visual indication and an audial indication on the display device.

20. The method of claim 15, further including operating the work machine under normal operating conditions when the monitored coolant fluid pressure is less than or equal to the expected coolant fluid pressure.

* * * * *